US007307230B2

(12) United States Patent
Chen

(10) Patent No.: US 7,307,230 B2
(45) Date of Patent: Dec. 11, 2007

(54) MECHANISM FOR CONTROLLING CIRCUIT-CLOSING/OPENING OF POWER RATCHET WRENCH

(75) Inventor: Hsin-Chi Chen, Taiping (TW)

(73) Assignee: Tranmax Machinery Co., Ltd., Taichung Hsien (TW)

( * ) Notice: Subject to any disclaimer, the term of this patent is extended or adjusted under 35 U.S.C. 154(b) by 0 days.

(21) Appl. No.: 11/397,761

(22) Filed: Apr. 5, 2006

(65) Prior Publication Data

US 2007/0187220 A1 Aug. 16, 2007

(30) Foreign Application Priority Data

Feb. 15, 2006 (TW) ..... 95202590 U

(51) Int. Cl.
*H01H 9/06* (2006.01)

(52) U.S. Cl. ..... 200/332.2; 200/522

(58) Field of Classification Search ..... 200/322.2, 200/522, 335, 343, 505; 81/467–470, 57–63.1
See application file for complete search history.

(56) References Cited

U.S. PATENT DOCUMENTS 4,054,766 A * 10/1977 Kramer ..... 200/522
4,064,447 A * 12/1977 Edgell et al. ..... 320/111
5,195,406 A * 3/1993 Lindqvist ..... 81/467
6,713,905 B2 * 3/2004 Hirschburger et al. ..... 310/47
6,890,135 B2 * 5/2005 Kopras et al. ..... 409/182
7,053,325 B2 * 5/2006 Yuasa et al. ..... 200/522
7,059,217 B2 * 6/2006 Horvath ..... 81/57.39
7,080,578 B2 * 7/2006 Izumisawa ..... 81/57.39
7,082,866 B2 * 8/2006 Becker ..... 81/479
7,137,761 B2 * 11/2006 Hara et al. ..... 408/16
7,171,873 B2 * 2/2007 Horvath ..... 81/57.39
2002/0035876 A1 * 3/2002 Donaldson Jr. ..... 73/862.21
2003/0094356 A1 * 5/2003 Waldron ..... 200/332.2
2004/0134316 A1 * 7/2004 Loper ..... 81/467
2005/0061119 A1 * 3/2005 Becker ..... 81/467

* cited by examiner

*Primary Examiner*—Elvin Enad
*Assistant Examiner*—Lisa Klaus
(74) *Attorney, Agent, or Firm*—Troxell Law Office, PLLC

(57) ABSTRACT

A mechanism for controlling circuit-closing/opening of power ratchet wrench, including: an elongated tubular main body for a user's hand to hold; a driving motor disposed in the main body; a transmission member disposed in the main body and connected with the driving motor for transmitting the power of the driving motor; a driving end disposed at the first end of the main body and drivable by the driving motor via the transmission member; a power supply for supplying power to the driving motor; a driving power supplying circuit disposed in the main body and electrically connected between the power supply and the driving motor, whereby the power supply can power on the driving motor via the driving power supplying circuit a controlling trigger, one end of the controlling trigger being pivotally connected with the main body. The controlling trigger is such arranged that when a user's hand encloses and holds the main body, the user's hand also encloses and holds the controlling trigger to control the closing/opening of the driving power supplying circuit.

5 Claims, 6 Drawing Sheets

MECHANISM FOR CONTROLLING CIRCUIT-CLOSING/OPENING OF POWER RATCHET WRENCH

BACKGROUND OF THE INVENTION

The present invention is related to a power ratchet wrench, and more particularly to a mechanism for controlling circuit-closing/opening of a power ratchet wrench.

A conventional power ratchet wrench has an elongated tubular main body in which various components of the power ratchet wrench are accommodated. Referring to FIG. 1, a user's hand can hold the main body to operate the power ratchet wrench 1. In operation, the user's thumb must always press the circuit-closing/opening press key 2 for closing the circuit to power on the driving unit inside the main body. When releasing the press key, the power is cut off.

In actual operation, the power ratchet wrench is often operated at high torque and high rotational speed. Under such circumstances, it is inconvenient for a user to hold the power ratchet wrench due to improper design of the circuit-closing/opening press key.

In order to stably operate the power ratchet wrench, a user's hand must tightly enclose and hold the main body of the power ratchet wrench. However, the user's thumb always needs to press the circuit-closing/opening press key. Therefore, the user's hand can hardly fully enclose the main body of the power ratchet wrench. Accordingly, the user's hand can hardly firmly hold the power ratchet wrench. Consequently, it often takes place that the power ratchet wrench jumps out of the user's hand due to shock in operation.

U.S. Pat. Nos. 6,923,095 and 5,195,406 disclose a control valve structure for closing/opening airflow passage of pneumatic ratchet wrench. Such control valve structure enables a user to more firmly hold the pneumatic ratchet wrench in operation. However, no similar measures applicable to power ratchet wrench have been disclosed.

SUMMARY OF THE INVENTION

It is therefore a primary object of the present invention to provide a mechanism for controlling circuit-closing/opening of a power ratchet wrench. When controlling the circuit-closing/opening of the power ratchet wrench, a user's hand can still fully enclose and stably hold the main body of the power ratchet wrench. Therefore, the power ratchet wrench will not jump out of the user's hand due to shock in operation so as to ensure safety.

It is a further object of the present invention to provide the above mechanism for controlling circuit-closing/opening of the power ratchet wrench, in which one single controlling trigger is used to control multiple circuit closing/opening controlling switches.

According to the above objects, the mechanism for controlling circuit-closing/opening of the power ratchet wrench includes: an elongated tubular main body for a user's hand to hold; a driving motor disposed in the main body; a transmission member disposed in the main body and connected with the driving motor for transmitting the power of the driving motor; a driving end disposed at the first end of the main body and drivable by the driving motor via the transmission member; a power supply for supplying power to the driving motor; a driving power supplying circuit disposed in the main body and electrically connected between the power supply and the driving motor, whereby the power supply can power on the driving motor via the driving power supplying circuit a controlling trigger, one end of the controlling trigger being pivotally connected with the main body. The controlling trigger is such arranged that when a user's hand encloses and holds the main body, the user's hand also encloses and holds the controlling trigger to control the closing/opening of the driving power supplying circuit.

The present invention can be best understood through the following description and accompanying drawings wherein:

DETAILED DESCRIPTION OF THE PREFERRED EMBODIMENTS

Figure 1:
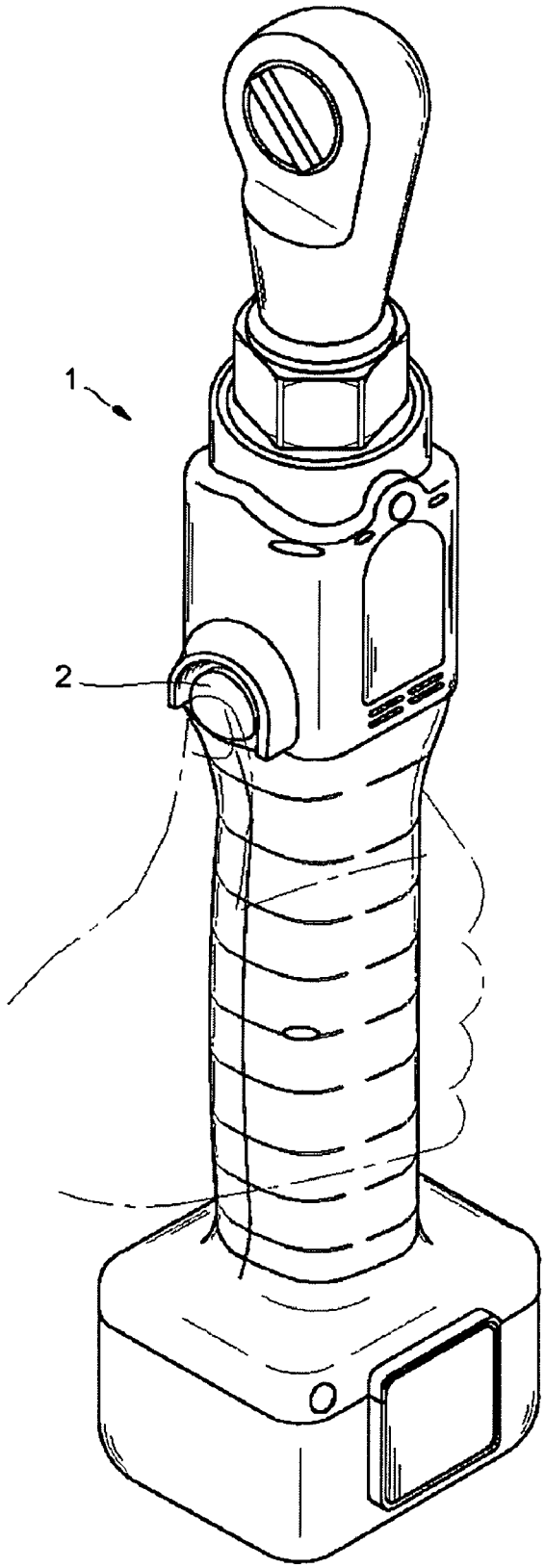
FIG. 1 is a perspective view of a conventional power ratchet wrench.
Figure 2:
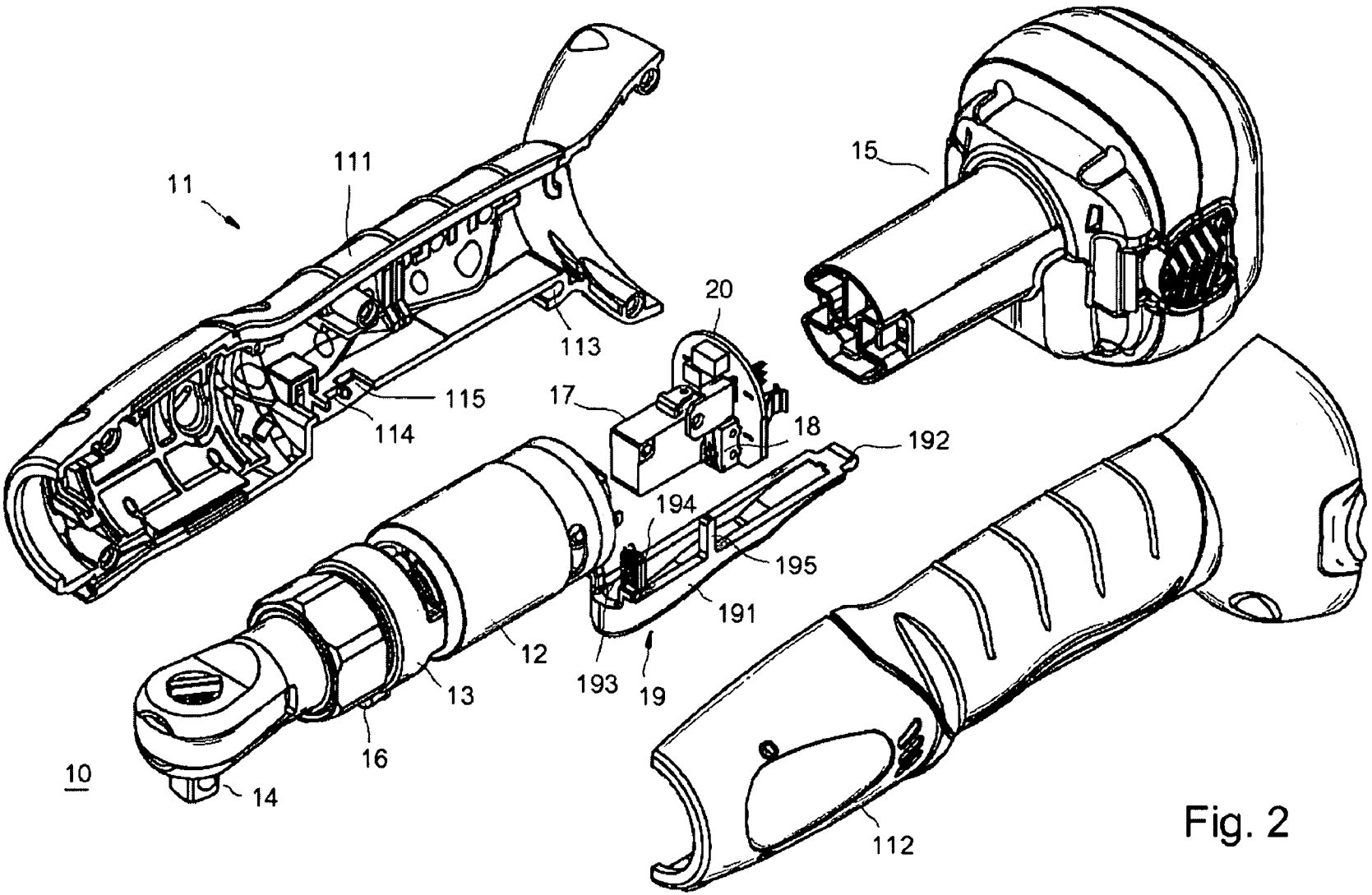
FIG. 2 is a perspective exploded view of a preferred embodiment of the present invention.
Figure 3:
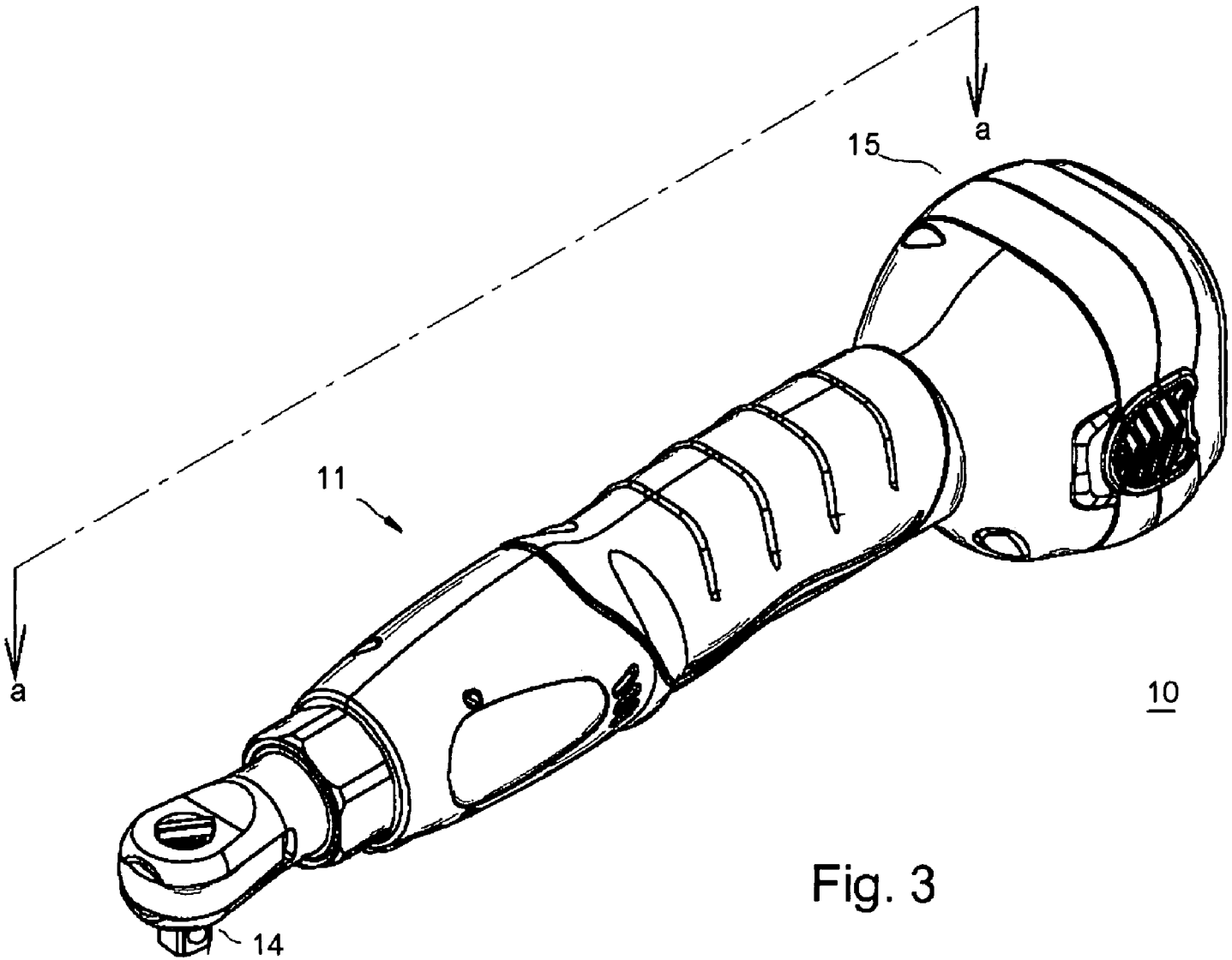
FIG. 3 is a perspective assembled view of the preferred embodiment of the present invention.
Figure 4:
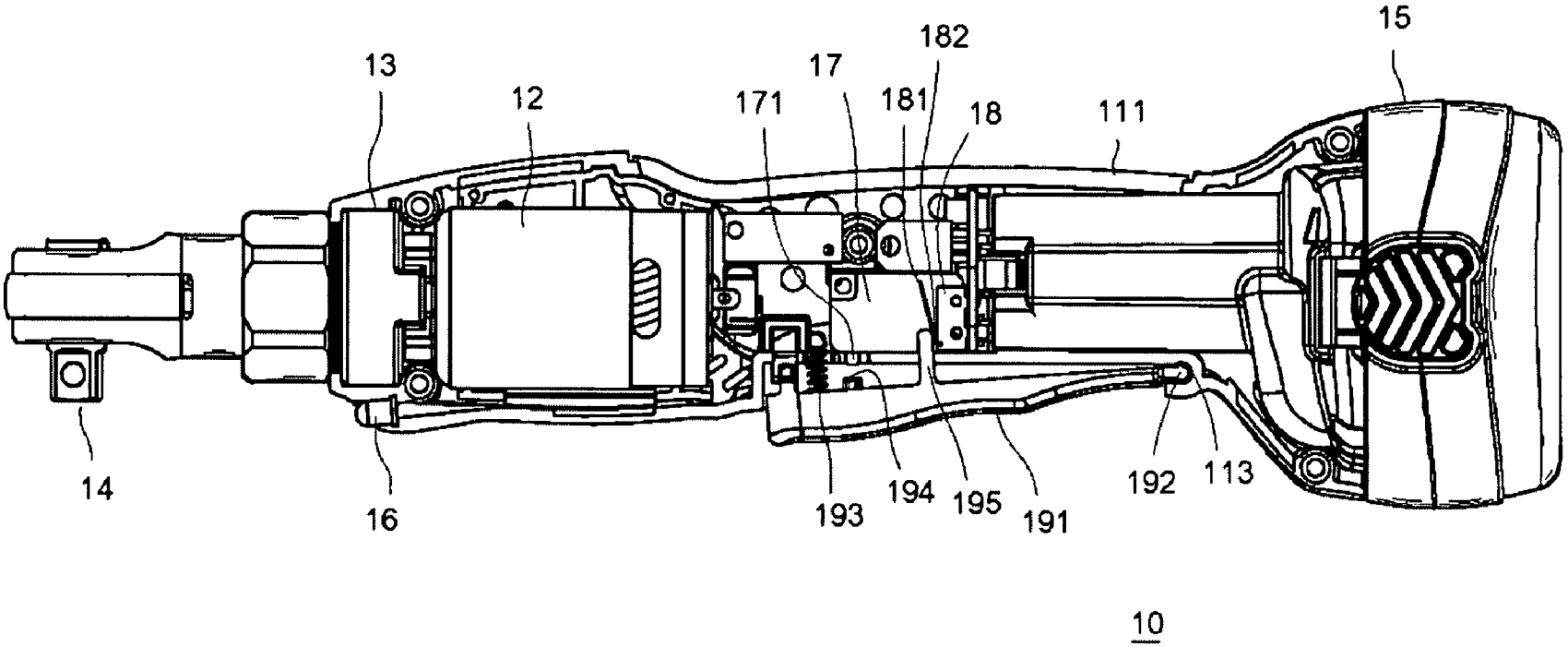
FIG. 4 is a sectional view taken along line a-a of FIG. 3.
Figure 5:
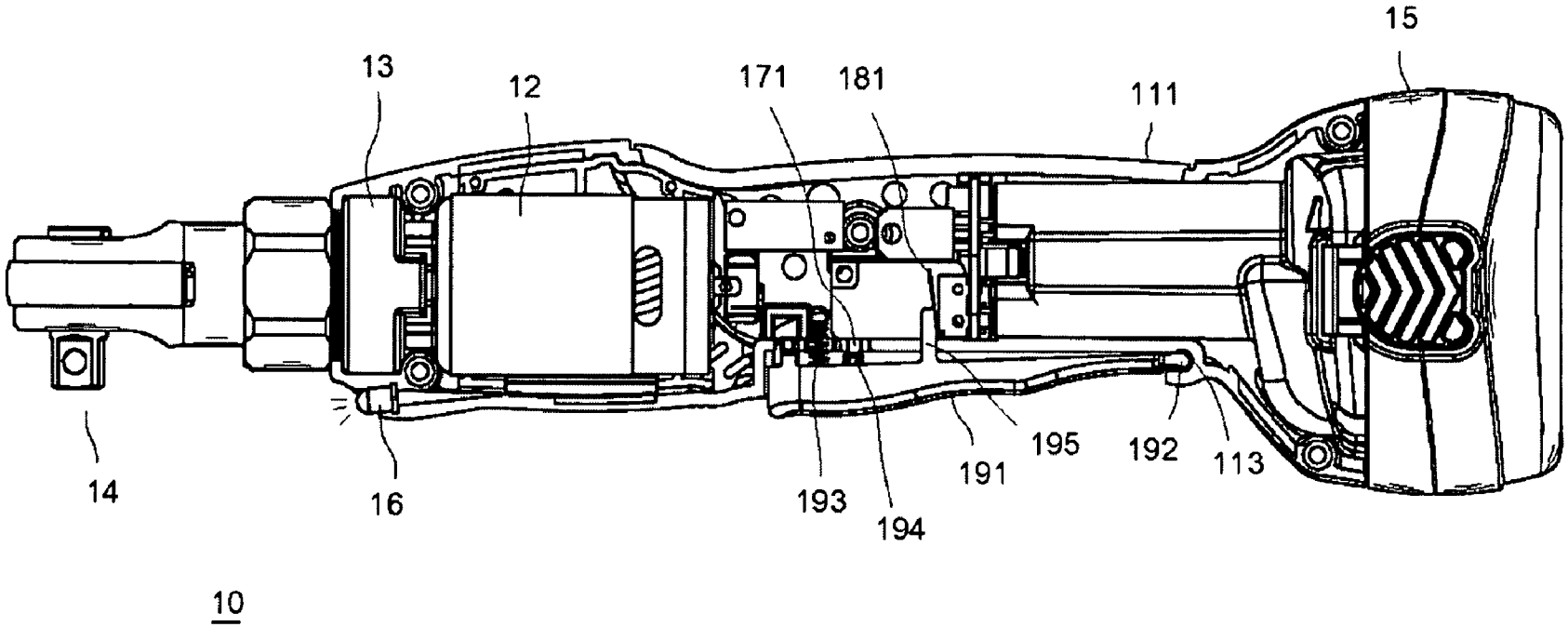
FIG. 5 is a sectional view according to FIG. 4, showing that the controlling trigger is positioned in a position where the controlling trigger controls closing/opening of the illuminating power supplying circuit.
Figure 6:
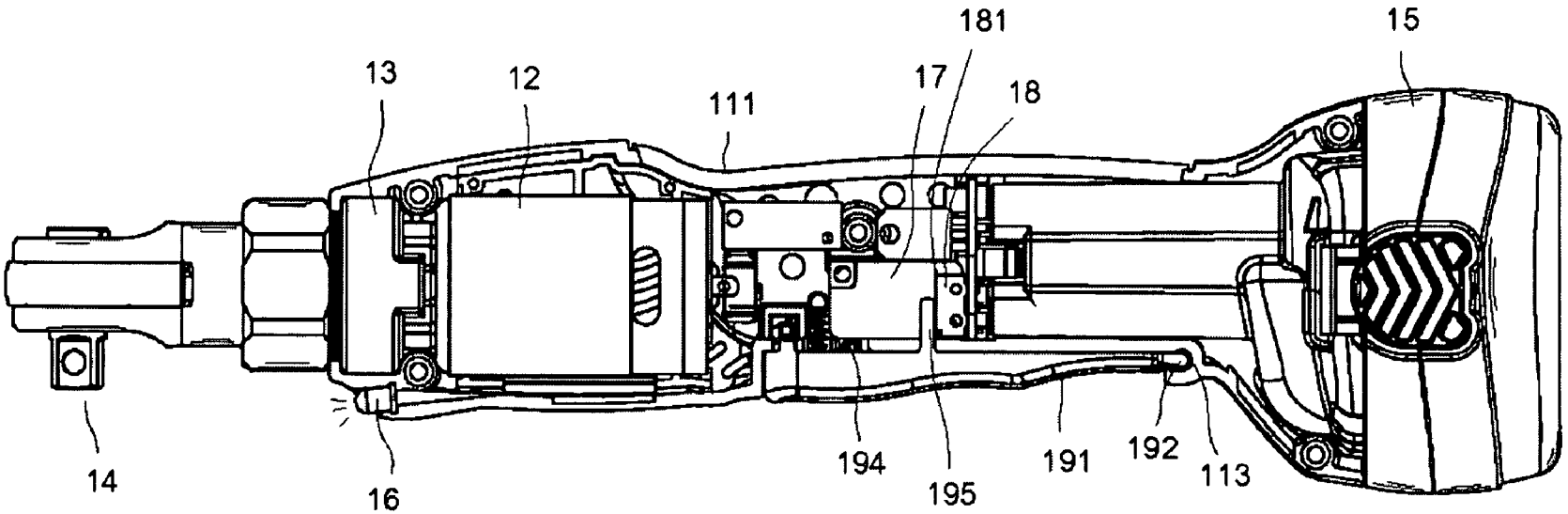
FIG. 6 is a sectional view according to FIG. 4, showing that the controlling trigger is positioned in a position where the controlling trigger controls closing/opening of the driving power supplying circuit.

Please refer to FIGS. 2 to 6. The mechanism 10 for controlling circuit-closing/opening of power ratchet wrench of the present invention includes a main body 11, a driving motor 12, a transmission member 13, a driving end 14, a power supply 15, an illuminating light 16, a driving power supplying circuit, an illuminating power supplying circuit, a driving circuit closing/opening controlling switch 17, an illuminating circuit closing/opening controlling switch 18 and a controlling trigger 19.

The main body 11 is an elongated tubular body composed of two halves 111, 112 mated with each other. The main body 11 has an internal space in which other components of the power ratchet wrench are accommodated. The main body has a configuration adapted to a human hand, whereby a user's hand can enclose and hold the main body.

The driving motor 12 is coaxially received in the internal space of the main body 11. The driving motor 12 has an output shaft parallel to the axis of the main body 11 and directed to a first end of the main body 11.

The transmission member 13 is shafted on the output shaft of the driving motor 12 and accommodated in the internal space of the main body 11.

The driving end 14 is disposed at the first end of the main body 11 and coupled with the transmission member 13. The transmission member 13 serves to transmit the power of the driving motor 12 to the driving end 14 for wrenching a work piece.

The power supply 15 is a power storage unit such as a cell package inserted in a second end of the main body 11 and extending into the internal space of the main body 11.

The illuminating light 16 can be a light-emitting diode fixedly disposed at the first end of the main body 11 and adjacent to the driving end 14. The illuminating light 16 serves to illuminate an operating area of the driving end 14.

The driving power supplying circuit and the illuminating power supplying circuit are respectively electrically connected between the power supply 15 and the driving motor 12 and the illuminating light 16. Accordingly, the power supply 15 can power on the driving motor 12 and the illuminating light 16 via the driving power supplying circuit and the illuminating power supplying circuit. The driving power supplying circuit and the illuminating power supplying circuit are combined into a circuit board 20 disposed in the main body 11.

The driving circuit closing/opening controlling switch 17 is fixedly disposed on the circuit 20 and electrically connected with the driving power supplying circuit. The driving circuit closing/opening controlling switch 17 has a touch-controlled key 171. When an external physical force is applied to the touch-controlled key 171, the touch-controlled key 171 mechanically controls the closing/opening of the driving power supplying circuit.

The illuminating circuit closing/opening controlling switch 18 is fixedly disposed on the circuit 20 and adjacent to the driving circuit closing/opening controlling switch 17. The illuminating circuit closing/opening controlling switch 18 has a press key 181 and a leaf spring 182 attaching to the press key 181. The press key 181 is operable in a direction parallel to the axis of the main body 11. Accordingly, the leaf spring 182 can exert a physical force onto the press key 181 to mechanically control the closing/opening of the illuminating power supplying circuit.

The controlling trigger 19 has an elongated body section 191 which is mounted on one side of the main body 11 in parallel to the axis thereof. One end of the body section 191 is formed with a pivot section 192 inlaid in a pair of pivot holes 113 of the two halves 111, 112 to pivotally connect the body section 191 with the main body 11. Accordingly, the body section 191 can be pivoted about the pivot section 192 between a releasing position and a pressing position. A spring 193 resiliently keeps the body section 191 in the releasing position. A first touch-controlled projection 194 is formed on the body section 191 and spaced from the pivot section 192 by a longer distance. The first touch-controlled projection 194 extends from the body section 191 by a shorter length. A free end of the first touch-controlled projection 194 can pass through a through hole 114 of the main body 11 to face the touch-controlled key 171. A second touch-controlled projection 195 is formed on the body section 191 and spaced from the pivot section 192 by a shorter distance. The second touch-controlled projection 195 extends from the body section 191 by a longer length. A free end of the second touch-controlled projection 195 can pass through a through hole 115 of the main body 11 to be adjacent to the leaf spring 182.

According to the above arrangement, in operation, when a user's hand encloses and holds the main body 11 of the power ratchet wrench, all the fingers of the user's hand except the thumb can pull or loosen the controlling trigger 19 to control the position of the controlling trigger 19. Accordingly, it is no more necessary to move the thumb for pressing or releasing the press key as in the conventional technique. Therefore, the user's hand can always enclose the main body 11 to more reliably hold the same in operation.

Moreover, in the above structure, one single controlling trigger 19 is used to simultaneously control both the driving circuit closing/opening controlling switch 17 and the illuminating circuit closing/opening controlling switch 18. When the user's hand encloses and holds the main body 11 tight, the controlling trigger 19 is pivotally biased from the releasing position to the pressing position. When the controlling trigger 19 reaches a position between the releasing position and the pressing position, the free end of the second touch-controlled projection 195 first presses the leaf spring 182 to switch on the illuminating circuit closing/opening controlling switch 18. Therefore, before the driving motor 12 is powered on, the illuminating light 16 first illuminates the operation area of the driving end 14. Then, when the user's hand further holds the main body 11 tight, the controlling trigger 19 is positioned in the pressing position where the free end of the first touch-controlled projection 194 presses the touch-controlled key 171 to switch on the driving circuit closing/opening controlling switch 17 for powering on the driving motor 12 and wrenching a work piece. This facilitates operation of the power ratchet wrench and ensures safety in use of the power ratchet wrench.

The above embodiments are only used to illustrate the present invention, not intended to limit the scope thereof. Many modifications of the above embodiments can be made without departing from the spirit of the present invention.

What is claimed is:

1. A mechanism for controlling circuit-closing/opening of power ratchet wrench, comprising:

a main body which is an elongated tubular body defining an internal space and having a configuration adapted to a human hand, whereby a user's hand can enclose and hold the main body;

a driving motor disposed in the main body;

a transmission member disposed in the main body and connected with the driving motor for transmitting the power of the driving motor;

a driving end disposed at the first end of the main body and coupled with the transmission member, whereby the transmission member transmits the power of the driving motor to the driving end for wrenching a work piece;

a power supply for supplying power to the driving motor;

a driving power supplying circuit disposed in the main body and electrically connected between the power supply and the driving motor, whereby the power supply powers on the driving motor via the driving power supplying circuit;

a driving circuit closing/opening controlling switch disposed on the main body and electrically connected with the driving power supplying circuit, whereby the driving circuit closing/opening controlling switch is mechanically operable to control the closing/opening of the driving power supplying circuit;

a controlling trigger, one end of the controlling trigger being pivotally connected with the main body, the controlling trigger being such arranged that when a user's hand encloses and holds the main body, the user's hand also encloses and holds the controlling trigger, the controlling trigger having a predetermined section for touching the driving circuit closing/opening controlling switch, when the user's hand encloses and holds the main body, an inner face of the user's hand touching and pressing the controlling trigger, whereby the user's hand can press or release the controlling trigger to control the closing/opening of the driving power supplying circuit; and an illuminating light disposed at the first end of the main body and adjacent to the driving end, the mechanism further comprising an illuminating power supplying circuit disposed in the main body and electrically connected between the power supply and the illuminating light, an illuminating circuit closing/opening controlling switch being disposed on the main body and electrically connected with the illuminating power supplying circuit, whereby the illuminating circuit closing/ opening controlling switch is mechanically operated to control the closing/opening of the illuminating power supplying circuit, wherein the controlling trigger has an elongated body section pivotally connected with the main body, a first touch-controlled protection extending from the body section into the internal space of the main body, whereby a free end of the first touch-controlled protection abuts against the driving circuit closing/opening controlling switch, wherein the controlling trigger further has a second touch-controlled projection extending from the body section into the internal space of the main body, whereby a free end of the second touch-controlled projection abuts against the illuminating circuit closing/opening controlling switch.

2. The mechanism as claimed in claim 1, wherein the controlling trigger is an elongated body arranged in parallel to the axis of the main body.

3. The mechanism as claimed in claim 1, wherein the controlling trigger is arranged on such a portion of the main body that when a user's hand holds the main body, the fingers of the user's hand except the thumb can fully hold the controlling trigger.

4. The mechanism as claimed in claim 1, wherein the second touch-controlled projection is positioned between the first touch-controlled projection and a pivot section of the body section.

5. The mechanism as claimed in claim 1, wherein the power supply is a cell.

* * * * *